United States Patent [19]

Crowell et al.

[11] Patent Number: 4,794,024

[45] Date of Patent: Dec. 27, 1988

[54] STABILIZER AND RIGIDIFIED POP-UP STRUCTURES RESEMBLING SOLID POLYHEDRONS

[75] Inventors: Christopher S. Crowell, Old Lyme, Conn.; Ib Penick, Palatine, Ill.

[73] Assignee: Structural Graphics, Inc., Essex, Conn.

[21] Appl. No.: 88,041

[22] Filed: Aug. 21, 1987

[51] Int. Cl.[4] ..... B65D 5/36

[52] U.S. Cl. ..... 428/12; 40/124.1; 52/DIG. 10; 446/148

[58] Field of Search ..... 428/9, 12, 542.2, 542.8; 40/124.1; 52/DIG. 10; 446/148

[56] References Cited

U.S. PATENT DOCUMENTS

| | | | |
|---|---|---|---|
| 1,292,188 | 1/1919 | Wheeler | 428/542.8 X |
| 2,833,074 | 5/1958 | Jannes | 428/12 |
| 3,010,246 | 11/1961 | England | 428/542.2 X |
| 3,234,682 | 2/1966 | Frankl | 446/148 |
| 3,562,077 | 2/1971 | Raba | 428/12 |
| 3,571,958 | 3/1971 | Stevens et al. | 40/124.1 |
| 4,084,015 | 4/1978 | Patterson | 428/9 |
| 4,319,418 | 3/1982 | Transport | 428/12 X |
| 4,380,133 | 4/1983 | Arnstein | 52/DIG. 10 |

*Primary Examiner*—Henry F. Epstein

*Attorney, Agent, or Firm*—Mattern, Ware, Stoltz & Fressola

[57] ABSTRACT

Attractive eye-catching desk-top decorations formed as flattenable pop-up cardboard structures resembling solid polyhedrons have similar polygons as top and bottom supporting panels. Foldably joined to the sides of each of these polygons are trapezoidal face panels extending diagonally outward with their longer parallel edges foldably joined to corresponding edges of mating trapezoidal face panels extending outward from the other polygon, forming an equatorial plane polygon similar to but larger than the top and bottom polygon panels. Internal glue tabs extending inward in the equatorial plane are urged toward each other by elastic bands, popping the flattened structures into their erect condition. Internal guide flanges formed by or cooperating with the glue tabs arrest and block the inward flexing movement of the trapezoidal face panels as the desired erect polyhedron shape is reached, stabilizing and rigidifying the structures to provide a prolonged useful life.

15 Claims, 6 Drawing Sheets

FIG. 2
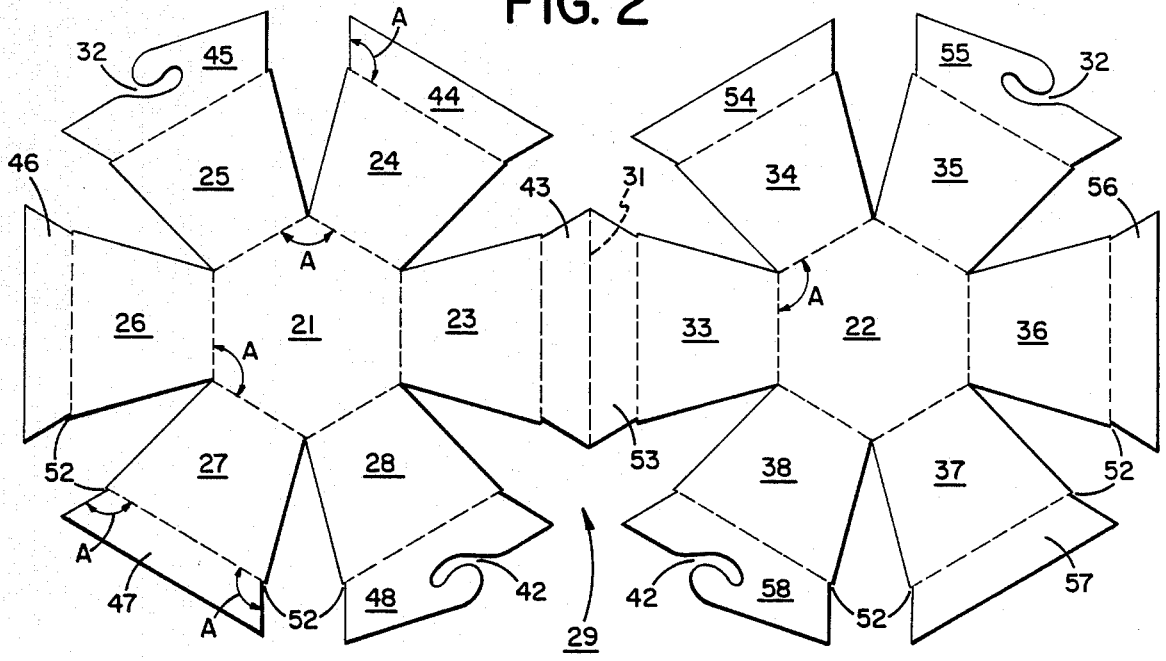
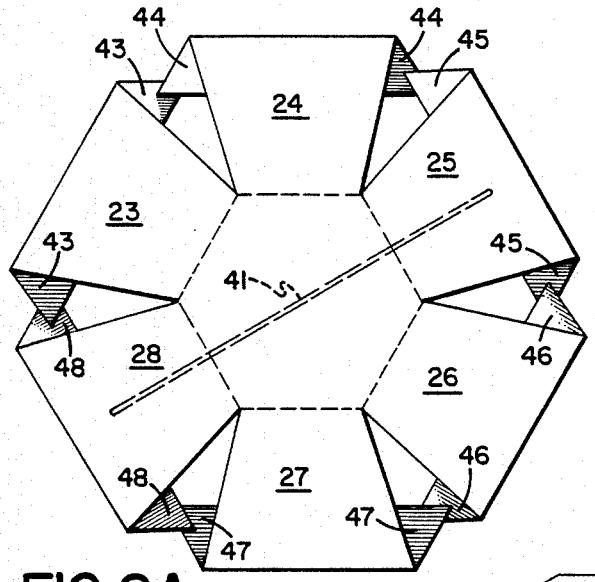
FIG. 2A
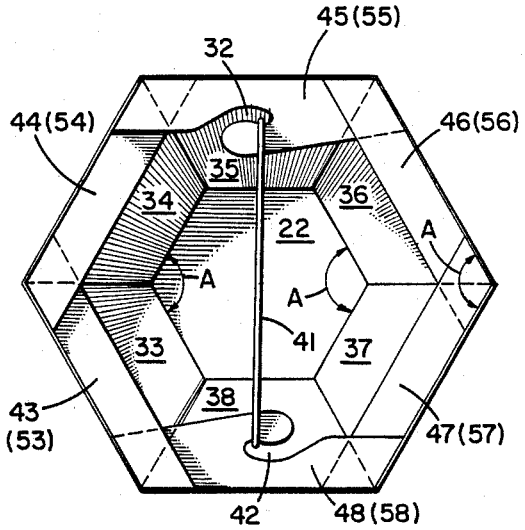
FIG. 2B
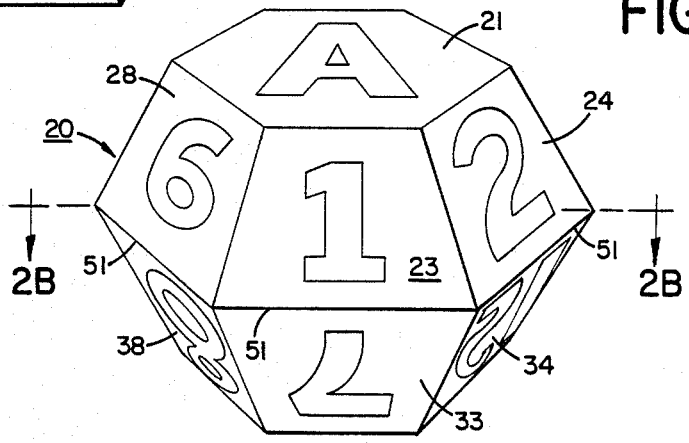
FIG. 1

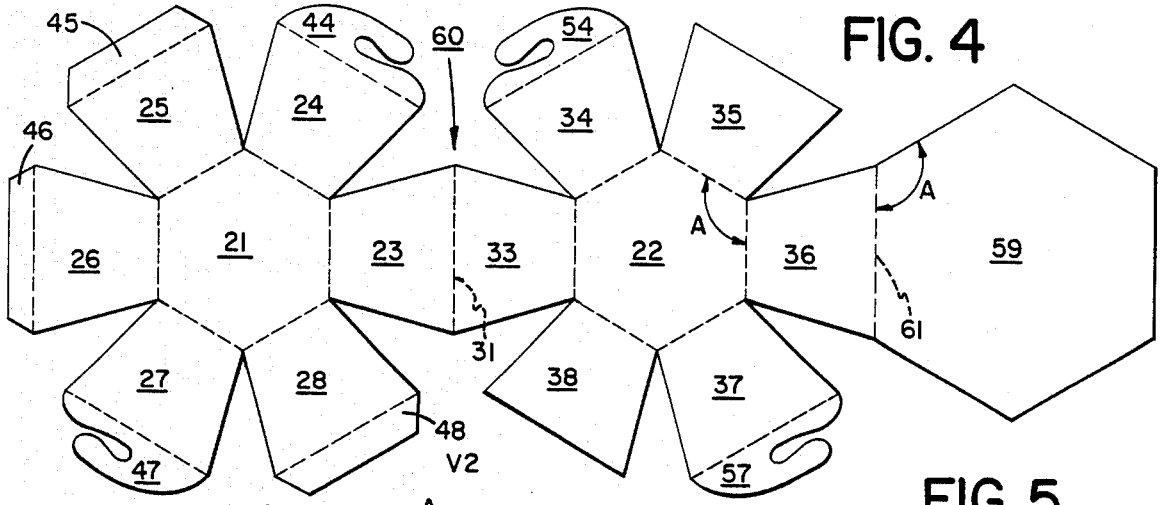
FIG. 4
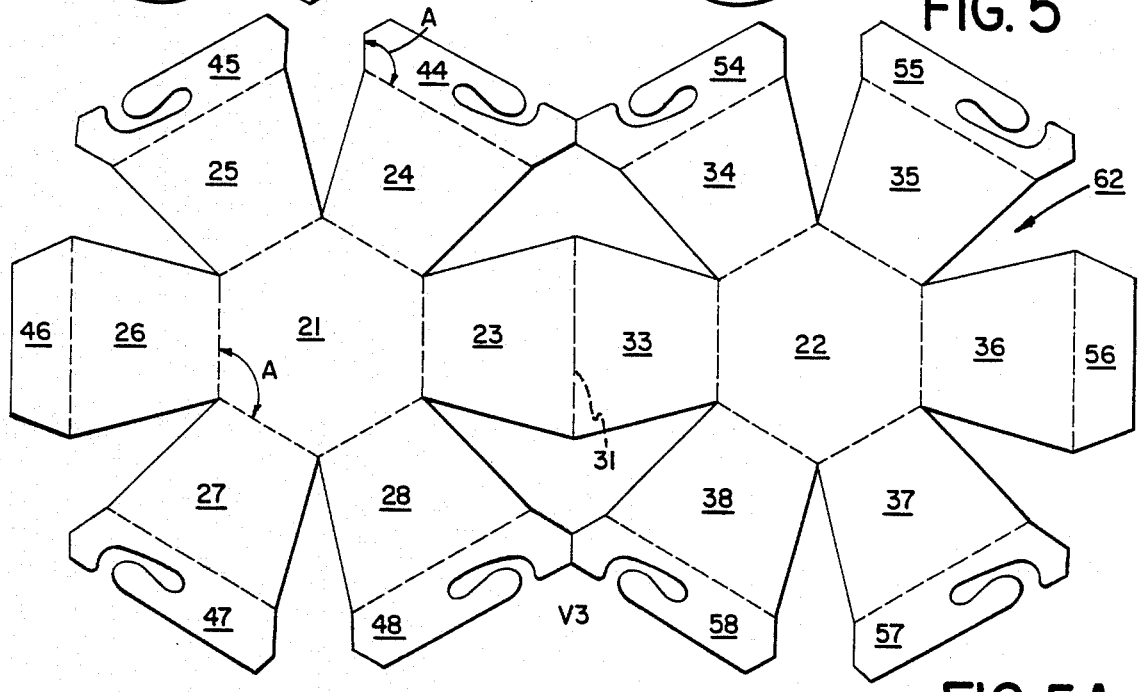
FIG. 5
FIG. 4A
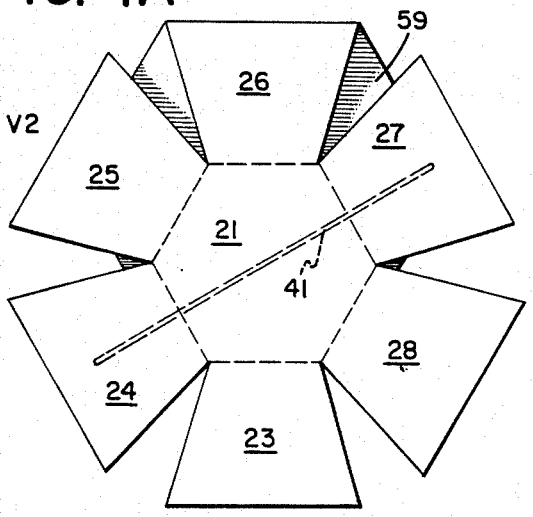
FIG. 5A
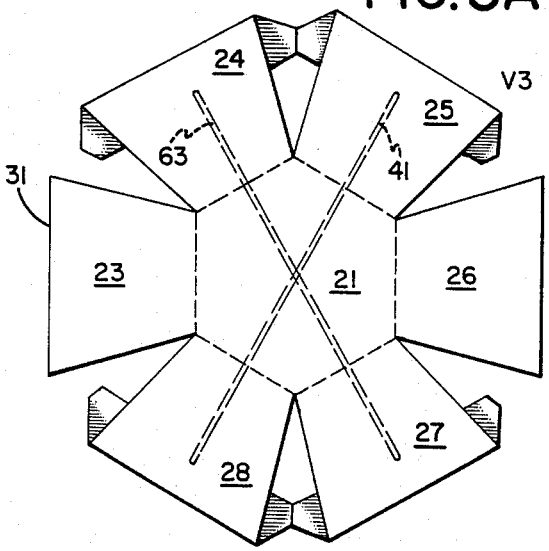

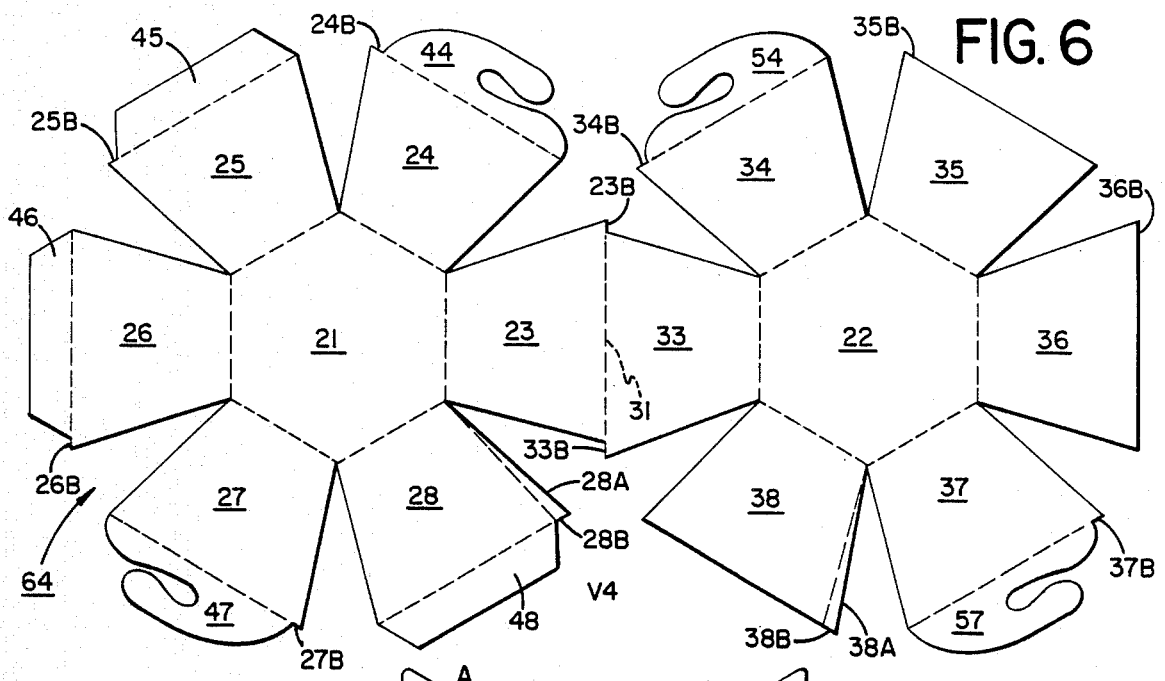
FIG. 6
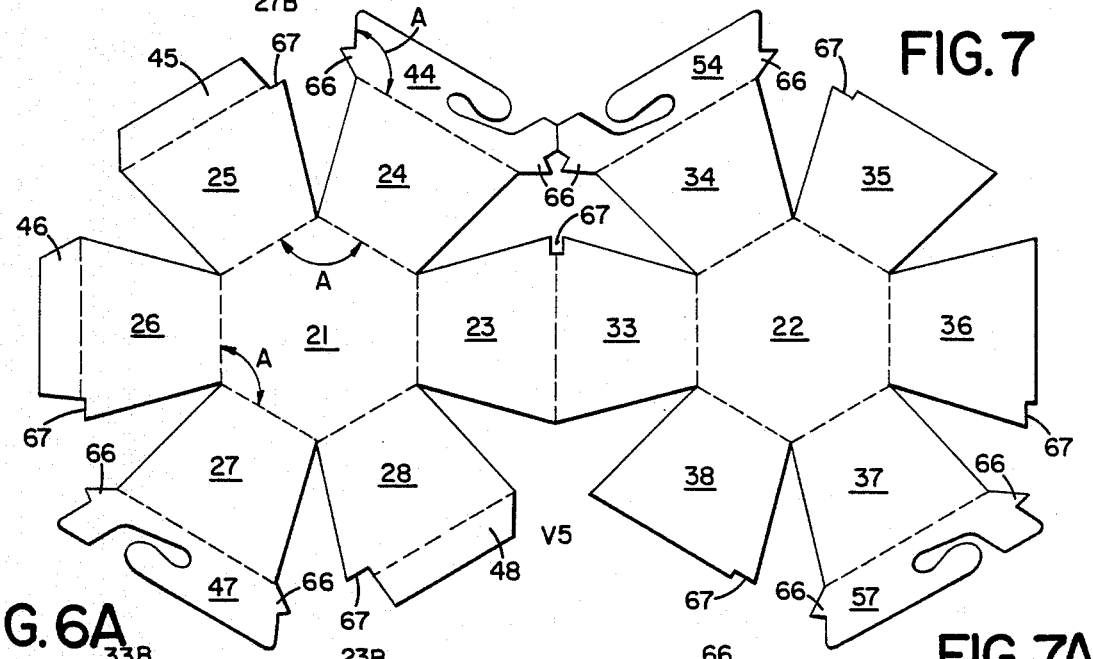
FIG. 7
FIG. 6A
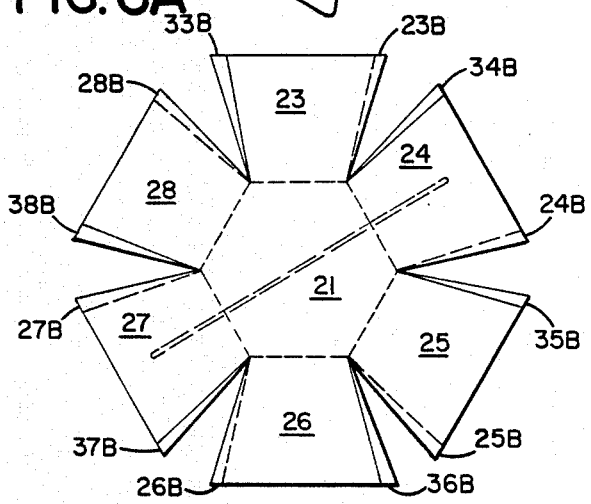
FIG. 7A
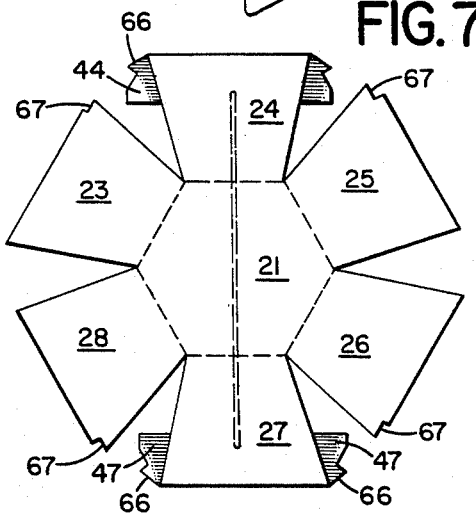

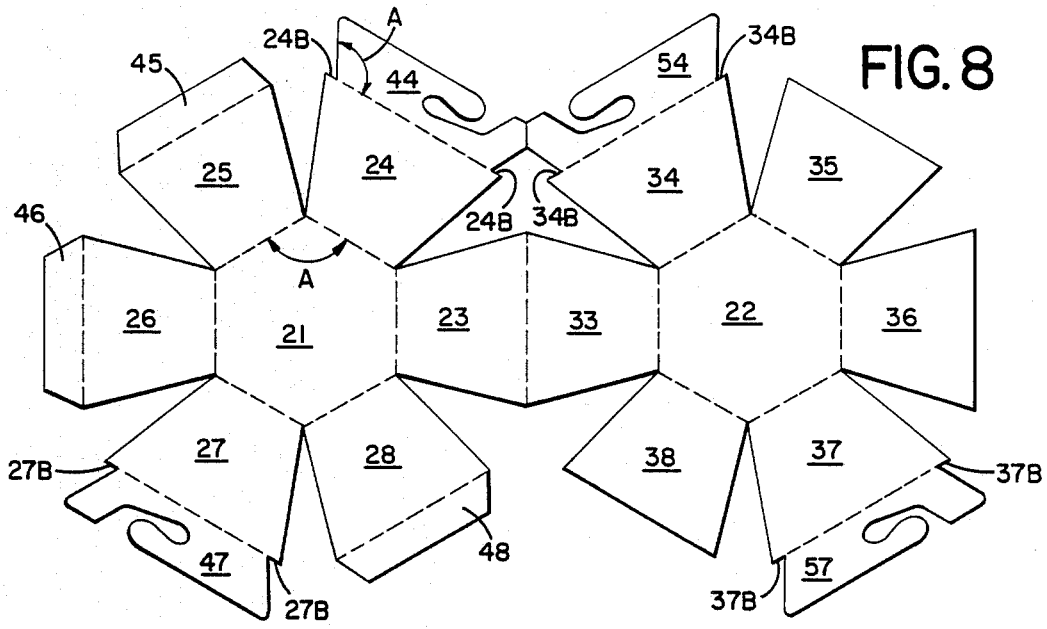
FIG. 8
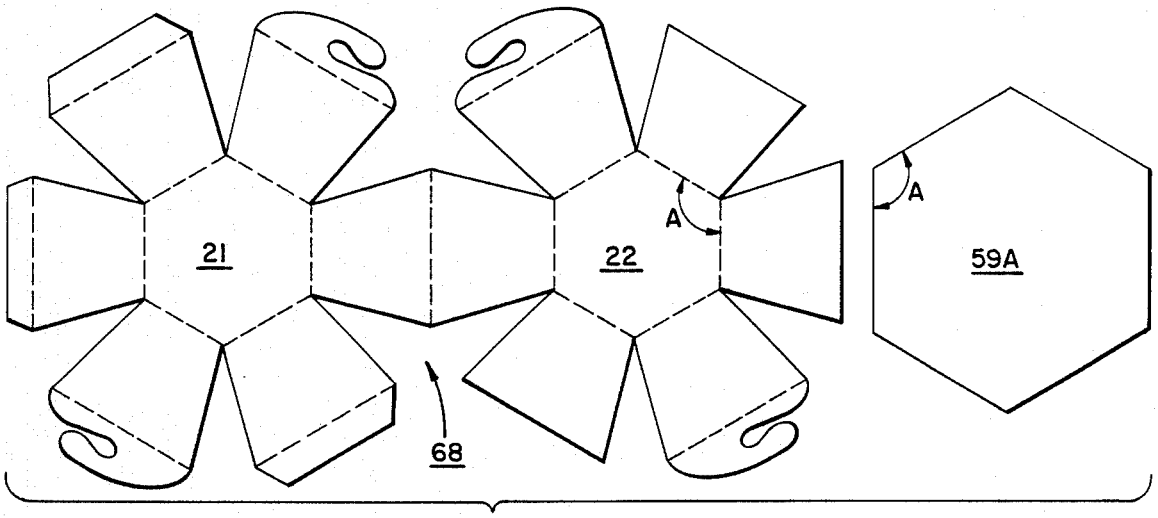
FIG. 9
FIG. 8A
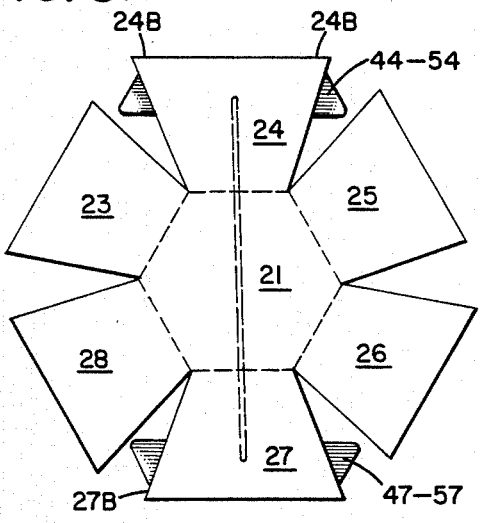
FIG. 9A
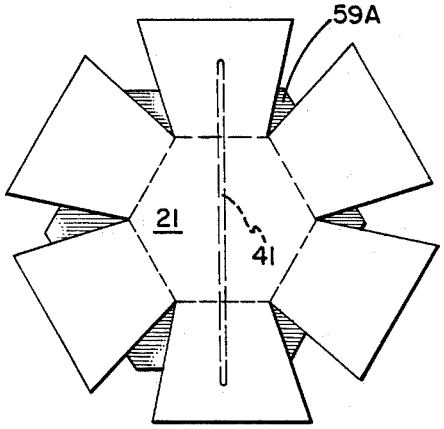

FIG. 10
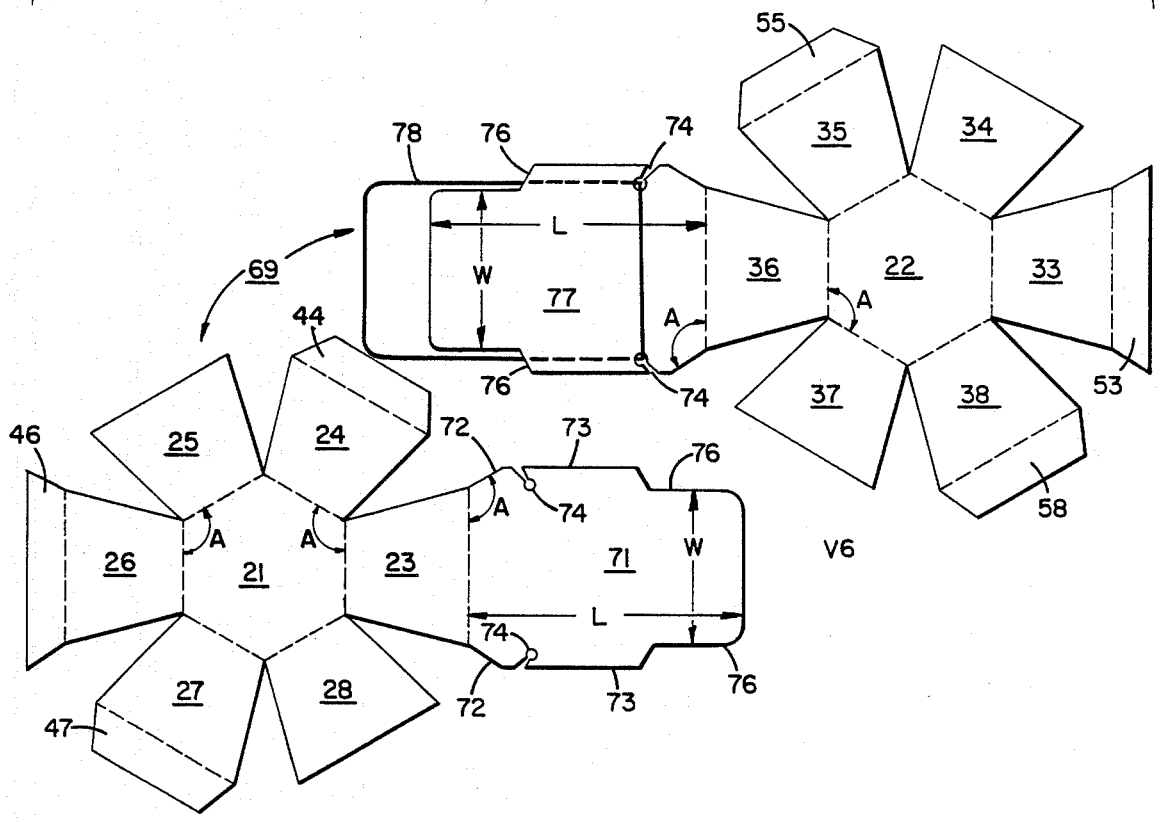
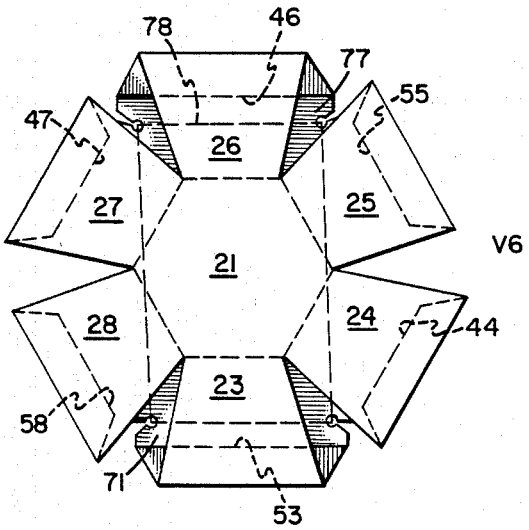
FIG. 10A

STABILIZER AND RIGIDIFIED POP-UP STRUCTURES RESEMBLING SOLID POLYHEDRONS

This invention relates to flattenable and self-erected pop-up structures having the external appearance of polygonal solids having 10, 14 or 18 faces, for example. More particularly, it relates to such structures fabricated from scored and folded cardboard for use as desk ornaments, calendars or advertising novelties.

Such self-erected pop-up polygonal structures are generally collapsible into a flattened configuration for envelope storage, shipping or mailing, from which they automatically pop up into erected configuration, actuated by one or more stretched internal elastic bands. The erecting forces imposed on the structure by these stretched elastic bands often overload the flexing sidewalls of these folded cardboard structures, and repeated cycles of collapse and erection may damage panel edges, cause misalignment, or produce inverting or destruction of these pop-up structures.

The present invention assures the integrity and long life of such flattenable pop-up structures by preventing panel edge damage and resisting misalignment. The attractive, decorative appearance of these structures is assured by the present invention, and the capability for carrying calendar information or displaying advertising messages is extended over a long useful life. Internal mitered flanges or similar corner-stabilizing guide flanges block misalignment and firmly resist inward collapse of these structures.

Accordingly, a principal object of this invention is to provide reliable, long-lived flattenable pop-up polygonal structures which are highly resistant to panel edge damage, deformation or destruction.

A further object of the invention is to provide flattenable pop-up polygonal structures with equatorial corner alignment flanges blocking misalignment of adjacent side panels and preventing panel edge damage.

Another object of the invention is to provide such structures which are readily and economically fabricated.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

BRIEF DESCRIPTION OF THE DRAWINGS

FIG. 1 is a perspective view of a flattenable pop-up structure of the present invention in its erected, display condition;

FIG. 2 is top plan view of a trimmed and scored blank, severed from a foldable sheet of stiff, lightweight material, ready to be assembled into a pop-up structure like that of FIG. 1;

FIG. 2A is a top plan view of the blank of FIG. 2, folded, glued and assembled, showing the pop-up structure in its flattened, collapsed condition;

FIG. 2B is a cross-sectional top plan view taken along a horizontal equatorial plane 2B—2B as shown in FIG. 1, illustrating the interior of the same pop-up structure in its erected condition;

FIGS. 4, 5, 6, 7, 8, 9 and 10 are successive top plan views of severed blanks, comparable to the blank of FIG. 2, designed to produce different modified embodiments of the invention;

FIGS. 4A, 5A, 6A, 7A, 8A, 9A and 10A are top plan views of the folded, glued and assembled blanks of respective FIGS. 4, 5, 6, 7, 8, 9 and 10, all showing the resulting pop-up structures in their flattened, collapsed condition;

BEST MODE FOR CARRYING OUT THE INVENTION

Figure 3A:
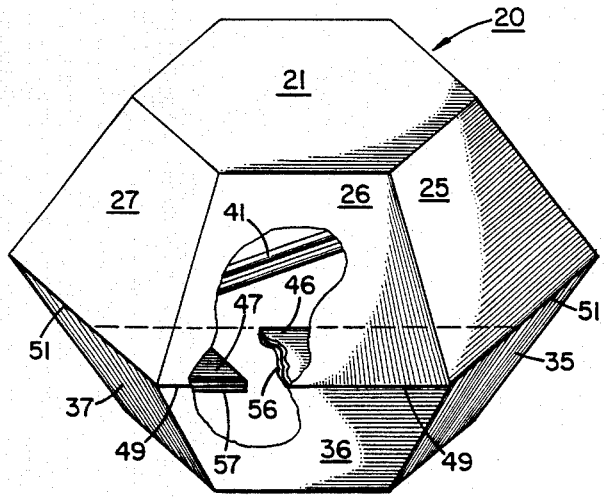
FIG. 3 is a cut-away perspective view of the same structure, showing its internal details.

The preferred form of a faattenable self-erecting polygonal structure suitable for a desk ornament, calendar advertising message carrier or the like is a 14-face "tessaradecahedron" such as the structure 20 shown in FIGS. 1 and 3. The structure 20 is characterized by a hexagonal top face 21 and a corresponding hexagonal bottom face 22 on which the structure normally rests, standing on a table top or any simllar supporting surface. Six outwardly slanting trapezoidal faces 23–28 extend diagonally outward from the hexagonal top face 21, with the short parallel edge of each trapezoidal face foldably joined to one side of the hexagonal top face 21. These trapezoidal faces 23–28 are all virtually identical trapezoids with their diverging sides abutting each other in the erected condition of the structure, as shown in FIGS. 1 and 3. In the flattened condition of the structure, illustrated in FIG. 2A for example the diverging sides of each trapezoid are spread apart in the same manner in which they are formed in the original blank 29 illustrated in FIG. 2. The second series of corresponding trapezoidal faces 33–38 have their short parallel edges foldably joined to their six respective long parallel edges of hexagonal bottom face 22, shown in FIG. 2.

In the assembled and self-erected condition of the structure 20, illustrated in FIG. 1, the long parallel edges of the upper trapezoidal faces 23–28 are correspondingly juxtaposed with the respective long parallel edges of the lower series of trapezoidal faces 33–38, as shown in FIG. 1, forming an attractive, stable and highly useful decoration which may carry information, advertising messages, calendar month indicia or any desired message. While the structure can be tilted and rotated to rest on any one of its 14 faces, it presents a "natural" and stable appearance to the observer when it stands upon one of its hexagonal faces 21 or 22, and this natural stable position may govern the imprinting of any message such as the numbers 1–6 shown in FIG. 1 and the inverted numbers 7, 8 etc. also showniin FIG. 1 which may be displayed conveniently when the structure 20 is inverted to rest upon its hexagonal face 21.

The 14-face structure is unusually well adapted to present the 12 months of the calendar, since each of the trapezoidal faces 23–28 and 33–38 can be employed to present a single calendar month, and the structure can be rotated as it rests upon either of its hexagonal faces 21 or 22 to facilitate the display of the current month, the past month or any future month desired. At the same time, the sponsor's advertising message may appear on each of the hexagonal faces 21 and 22 so that it will be continuously displayed in each of the stable positions of the structure.

To assure the proper operation of the flattenable and self-erecting pop-up structures of the invention, a series of glue tabs are provided, extending radially outward from the longer parallel edges of each trapezoidal face panel, and the glue tabs are foldably joined to these edges. Blank 20 in FIG. 2 is severed from its surrounding sheet along the solid peripheral lines, and scored for folding along the dashed fold lines. As shown in FIG. 2, glue tabs 43–48 are thus foldably joined to the longer parallel edges of respective trapezoidal panels 23–28 by the dashed foldable score lines coinciding with those edges. In a similar manner, glue tabs 53–58 are likewise foldably joined along foldable score lines coinciding with longer parallel edges of trapezoidal panels 33–38 forming the lower half of the overall polygonal structure, illustrated in FIG. 1. For convenience, one of the upper series of glue tabs 43 is preferably joined in the same manner along its straight outer edge to glue tab 53 extending outward from trapezoidal panel 33, as shown in blank 29 in FIG. 2.

The assembly of the structure can easily be visualized by reference to FIG. 2, where the underside of each glue tab 43–48 and 53–58 is coated with suitable adhesive either before or after the glue tabs are folded upward out of the plane of the paper and inward toward their respective hexagonal faces 21, 22 to overlie the respective corresponding trapezoidal faces 23–28 or 33–38 to one of which each of the glue tabs is foldably joined. The adhesively coated undersides of tabs 43 and 53 are joined by raising their common score line 31 upward out of the plane of the paper while thus rotating each of the tabs 43 and 53 about its common fold line with its supporting trapezoidal face 23 or 33, thus bringing the glue coated undersurfaces of glue tabs 43 and 53 together. The entire left half of blank 29 in FIG. 2 is next rotated upward, out of the plane of the blank 29, about the now superimposed long parallel edges of trapezoidal panels 23 and 33. The left portion of the blank 29 of FIG. 2 with its infolded glue coated tabs 44–48 is thus rotated 180 degrees into juxtaposition with the right-hand portion of the blank of FIG. 2 with its infolded glue tabs 54–58. As this folding operation continues, the glue coated surfaces of glue tabs 44 and 54 are brought into contact and the glue coated surfaees of glue tabs 48 and 58 are brought into contact followed by the corresponding juxtaposed contact of the infolded glue coated glue tabs 45 and 55, 47 and 57 and 46 and 56. Each pair of adhesively joined glue tabs thus forms an inwardly protruding flange extending into the interior of the structure, producing a stiffening and rigidifying internal guide flange. The corners of these guide flanges are illustrated in FIG. 2A, for example.

The upper trapezoidal faces 23–28 are all peeferably substantially identical, as shown in FIG. 22. While the mating long parallel edges of each pair of upper and lower face panels should substantially match, and while lower trapezoidal faces 33–38 are all preferably identical with each other, it is not essential that they be exactly identical to the upper trapezoidal faces 23–28. For example, if the upper trapezoidal faces 23–28 have their parallel edges closer together than those of the lower series of trapezoidal faces 33–38, the central equatorial hexagonal rim of the structure at its central plane 2B formed by the juxtaposed longer parallel edges of the upper series and the lower series of trapezoidal faces will not be equally spaced between top face 21 and lower face 22, but instead will be closer to top face 21, producing an overall polygonal structure with its upper portion appearing flatter than its lower portion, such as that shown in U.S. Pat. No. Des. 288,410 issued to Christopher S. Crowell on Feb. 24, 1987. Thus the included angles between the parallel edges of the trapezoidal faces and their diverging sides are not in any way critical and may be chosen to produce the desired decorative appearance of the overall structure.

Prior art flattenable pop-up self-erectable structures have incorporated most of the foregoing features, as well as notches formed in the free internal edges of opposed pairs of glue tabs inside the structure to be joined by a stretched elastic band, such as band 41 engaging corresponding notches 32 formed in the mating glue tabs 45 and 55, and similar notches 42 formed in the mating glue tabs 48 and 58. When these notches are connected by stretched elastic band 41, shown in dashed lines in FIG. 2A, and in solid lines in FIG. 2B, spanning the interior of the structure, the elasticity of band 41 tends to draw flanges 45–55 toward flanges 48–58 with such force that their supporting mating trapezoidal faces 28–38 and 25–35 are pivoted apart, separating the upper and lower hexagonal faces 21 and 22 and forcing the flattened structure to pop-up in self-erecting fashion to form the decorative desk top display 20 of FIG. 1.

Misalignment and Destructability of Prior Art Structures

A significant disadvantage of such prior art structures is created by the force required in elastic band 41 to cause the desired self-erecting pop-up operation, bringing the diverging edges of the adjacent trapezoidal faces together along meridional planes vigorously. The elastic bands often actually produce force sufficient to draw the band-connected pairs of trapezoidal faces inward, past the adjacent trapezoidal face pairs, misaligning the meridional abutting edges and causing the structure to "cave in," destroying its integrity. While such misalignment and destruction may not occur during the first few flexing pop-up operations of the device, prior art structures formed from scored and folded cardboard rarely last for a full year, preferably required as the useful life of a desk top calendar, for example. This vulnerability to destruction in normal use has detracted from the commercial usefulness of such prior art pop-up structures.

The unique devices of the present invention overcome this disadvantage with striking effectiveness. It has now been discovered that the internally protruding glue tabs themselves may be shaped to form reinforcing and rigidifying corner guides, effectively controlling the mating abutting juxtaposition of the protruding equatorial corners of the structure as it reaches its self-erected pop-up condition shown in FIG. 1, and blocking misalignment of the diverging trapezoidal panel edges.

This desirable result is preferably accomplished by the unique shape of glue tabs 43–48 and 53–58. As shown in FIG. 2, each of these tabs is essentially formed as a trapezoid not corresponding to its supporting trapezoidal panel. Instead, the glue tabs 43–48 and 53–58 are each formed with precise included obtuse angles A between their lateral edges and the scored fold lines joining them to their respective supporting trapezoidal face panels. As shown in the preferred embodiment of FIG. 2, these included obtuse angles A are substantially exactly 120 degrees, corresponding to the included angles A between the peripheral edges of hexagonal top panel 21 and lower panel 22.

The resulting alignment guide operation of the internal equatorial flanges formed by the mating adhesively bonded pairs of glue tabs is best shown in FIG. 2B and in corresponding FIGS. 5B, 6B, 7B, 8B and 10B. In each of these Figures, it will be observed that the diverging lateral edges of each internally protruding equatorial flange formed by the adhesively bonded pairs of glue tabs precisely abuts the interior face of the adjacent pair of mating trapezoidal face panels, with the included obtuse angle of 120 degrees of the guide flange substantially exactly corresponding to the included angle A between the adjoining pairs of trapezoidal face panels at the apex or corner point of their edge abuttment in the equatorial plane.

In the right-hand side of FIG. 2B, for example, inturned glue tabs 47–57 forming the inwardly protruding equatorial flange projecting from the mating equatorial junction of trapezoidal panels 27 and 37 and have their lateral edges diverging by the obtuse angle A of exactly 120 degrees from that equatorial junction between panel 27 and 37. These lateral edges thus directly abut the interior faces of adjoining panels 26–36 and 28–38 at their respective equatorial junctions where these pairs of mating trapezoidal panels also have adhesively joined glue tabs 45–56 and 48–58 forming internal projecting flanges which likewise have lateral side edges diverging at exactly 120 degrees from their equatorial junction lines to abut the internal faces of panels 27 and 37 at their common equatorial junction. Thus each abutting pair of trapezoidal panels meeting at a meridional plane has its aligned abutting meridional engagement reinforced and guided by two mating pairs of adhesively joined glue tabs protruding inwardly to form internal guide flanges, and thus sturdily resisting any tendency of either adjoining pair of trapezoidal panels to force itself inwardly past the other adjoining pair of trapezoidal panels.

The highly effective cooperation of these various components of the structures of this invention is thus illustrated in the cross-sectional top plan view of FIG. 2B add also in the cutaway perspective view of FIG. 3. In this cutaway view, trapezoidal panels 26 and 36 meeting along the equatorial junction line 49 are prevented from drawing inward beyond the pop-up self-erected position shown in FIG. 3 by the lateral edge of adhesively joined glue tabs 47 and 57 protruding inwardly from the equatorial junction line 51 of adjacent trapezoidal face panels 27 and 37, as shown in the cutaway central portion of FIG. 3. At the same time, panels 27 and 37 meeting along their own equatorial junction line 51 are equally blocked from flexing inward beyond the position shown in FIG. 3 by the diverging lateral edges of adhesively bonded glue tabs 46 and 56 protruding inwardly from equatorial junction line 49 joining the adjacent trapezoidal panels 26 and 36.

In the preferred embodiments of the invention, this same reinforcement of each adjoining pair of trapezoidal panels at the equatorial plane is produced by overlapping internal flanges such as flanges 46 and 47 shown in FIG. 2B and in FIG. 3. In pop-up self-erecting structures formed with adjacent pairs of trapezoidal faces joined along equatorial junction lines, the number of such pairs of course corresponds to the number of sides of the top and bottom panels such as panels 21 and 22 shown in FIG. 2, where the hexagonal faces have six sides and the structures incorporate six pairs of joined trapezoidal faces.

If the upper and lower faces were formed as four-sided polygons, such as squares or rectangles, with substantially 90-degree included angles A between their sides, then the angle between the lateral edges of the mating glue tabs forming internally protruding flanges would also form substantially 90-degree angles with the equatorial fold lines formed by the joined long parallel edges of the trapezoidal face panels.

In the same manner, if the top face of the structure is formed as an octagon, as in the flattenable pop-up structure shown in U.S. Pat. No. Des. 288,410, wherein the included angles between adjacent edges of the top face are 135 degrees, then the included angles between the lateral edges of the adhesively bonded glue tabs forming internally protruding guide flanges at the equatorial plane of the structure will also be substantially precisely 135 degrees, to assure effective abutting engagement between the lateral edges of these internal protruding flanges and the interior equatorial junction of the pair of trapezoidal face panels drawn inward toward the guide flange by the self-erecting force of the elastic band, such as band 41 shown in FIGS. 2A and 2B.

Again if the top face of the structure is a regular seven-sided heptagon, the guide flange angles and apex angles A should all be substantially equal to 128.6 degrees; for a regular pentagon, angles A should be substantially 108 degrees; for an equilateral triangle, angles A should be substantially 60 degrees.

If irregular polygons with unequal included apex angles are employed as top and bottom face panels, the guide flange angles at the equatorial end of each diverging meridional edge should preferably match the apex angle at the opposite end of the same meridional edge.

A further preferred refinement illustrated in FIG. 2 producing a precise adjoining and abutting engagement of the diverging edges of the adjoining pairs of trapezoidal face panels is shown at the end of each long parallel edge of every trapezoidal face panel where the lateral edge of its respective glue tab protrudes therefrom. It will be noted that the lateral edge of each glue tab is slightly offset inwardly by a small amount corresponding to the thickness of the foldable sheet stock from which blank 29 is severed. This slight offset by the thickness of the sheet stock assures that the equatorial corner junctions between adjoining pairs of trapezoidal panels will be guided together by their respective internal overlapping lateral flange edges, and will not be forced or held apart to permit the viewer to peek into the interior of the structure through a crack left open between these adjoining diverging trapezoidal face panel edges. This slight offset is identified as 52 in the lower portion of FIG. 2, and it is preferably formed at the lateral edge of each glue tab extending from each trapezoidal face panel in the preferred embodiments of the present invention.

Alternative Embodiments of the Invention

FIGS. 4 through 10A illustrate a number of different embodiments of the invention incorporating variations in particular features. Thus a single unitary guide flange 59 formed in the shape of a single large flat polygon corresponding in shape to the polygons forming top and bottom faces 21 and 22 is shown in FIG. 4. Polygon 59, however, is dimensioned to match the equatorial plane of the interior of the erected structure when the self-erecting elastic band has drawn it into its fully erected position, with all adjoining pairs of trapezoidal face panels brought into close abutting engagement. In this position, polygonal guide flange 59 occupies the entire equatorial plane of the structure and each side edge of flange 59 is dimensioned to correspond substantially precisely with the length of each longer parallel edge of each trapezoidal face panel.

FIG. 4A shows the structure of the blank FIG. 4 folded into its assembled condition and flattened for storage or shipping, in the manner generally shown in FIG. 2A. In FIG. 4A it will be noted that only the single guide flange 59 foldably joined along the longer parallel edge of trapezoidal face panel 36 is exposed between the diverging trapezoidal face panels in the collapsed flattened condition of the assembled structure shown in FIG. 4A and the glue tabs carrying the slots or hooks 32, 42 engaging the elastic band 41, tabs 44, 47, 54 and 57, have rounded ends whose outer lateral end shape is not required to provide a guiding function.

The same is true of the remaining glue tabs 45, 46 and 48, which are employed merely to assemble the structure by adhesive engagement with the interior face of the adjacent trapezoidal face panels 35, 36 or 38. Before folding of the top and bottom portions of the blank 60 along the central score line 31 which foldably joins panels 23 and 33, guide flange 59 is folded inward about the outer score line 61 folaably joining guide flange 59 to its supporting trapezoidal face panel 36. This brings the guide flange 59 between the upper and lower portions of the structure, which are then joined together by the adhesive glue tabs.

Only the slotted tab pairs 44–54 and 47–57 are mated to form internally projecting flanges, thus providing the notch points for anchoring elastic band 41 spanning the width of the structure between these opposed pairs of slotted flanges. Band 41 preferably embraces the polygonal guide flange 59 within its elastic closed loop, and thus assures the centering of the guide flange 59 along the equatorial plane defined by the elastic band 41 spanning the structure at its mid-section.

Since the guide flange 59 provides the entire guiding function required to assure the proper alignment of all adjoining pairs of trapezoidal face panels, the structural integrity of the assembled device is substantially equal to that provided by the preferred embodiment of FIGS. 1 through 2B. It will be noted in FIG. 4 that blank 60 requires no guide flange tabs between the trapezoidal face panels 23 and 33, since the alignment of these panels with their adjoining pairs of trapezoidal face panels is assured by the edge of guide flange 59 opposite to oute score line 61, as the assembled structure is erected from the flattened condition shown in FIG. 4A toward its elastically self-erected condition corresponding to that shown in FIG. 1.

Another modified embodiment of the invention is exemplified by the blank 62 shown nn FIG. 5, corresponding generally to the blank 99 shown in FIG. 2. Blank 62, however, omits the internal guide flange glue tab segments joining trapezoidal face panels 23 and 33 in the same manner that these are omitted from the blank 60 of FIG. 4. Blank 62 is severed from its surrounding sheet by severing along all solid lines defining the outline of blank 62, and the blank is scored along all dash lines forr folding in the manner described above. All of the peripheral glue tabs have their undersides coated with glue patches, as viewed in FIG. 5, and are folded upward out of the plane of blank 62, overlying their respective trapezoidal face panels, after which the upper or left-hand portion of the structure 21–28 is folded upward out of the plane of blank 62 about fold line 31 joining it to the lower right-hand portion of the structure 22–38, bringing all of the infolded glue coated tabs into juxtaposition.

As illustrated in FIG. 5A, the resulting assembled and flattened collapsed structure is provided with two elastic bands 41 and 63 connecting two pairs of slotted internally projecting guide flange glue tabs, thus permitting the use of lighter weight and less powerful elastic bands 41 and 63, minimizing the risk of misalignment and resulting destruction of the assembled and self-erected structure.

If desired, as shown in FIGS. 5 and 5A, glue tabs between mating trapezoidal face panels 23 and 33 may be omitted and glue tabs connecting the opposite pair of trapezoidal face panels 26 and 36 may have their ends beveled rather than projecting with the required 120-degree included angle A, thus protecting four out of the total of six pairs of mating trapezoidal face panels from overdeflection as indicated in FIG. 5A. The inward self-erecting movement of the pairs of face panels joined byeelastic bands 41 and 63 is limited by the guide flange glue tabs projecting inwardly between these pairs of face panels and their respective adjoining pairs of face panels also engaged by the other elastic band. The remaining non-actuated opposed pairs of trapezoidal face panels may, therefore, omit protective guide flanges, relying instead upon the elastic band-actuated pairs of face panels interfitting and blocking each other's inward movement at the desired self-erected condition.

Figure 5B:
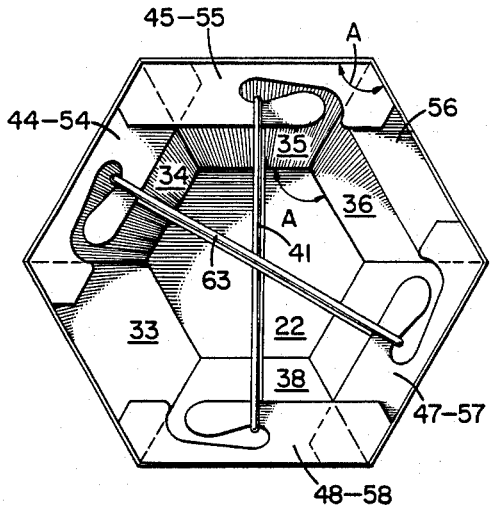
FIGS. 5B, 6B, 7B, 8B and 10B are cross-sectional top plan views taken along horizontal equatorial planes corresponding to plane 2B—2B in FIG. 1, showing the interiors of the different assembled and erected pop-up structures formed from the blanks of respective FIGS. 5, 6, 7, 8 and 10.

FIG. 5B shows a cross-sectional plan view cut away just above the equatorial plane to show the structure assembled and erected from the blank of FIG. 5 in its self-erected condition where the upper left and lower right cooperating guide flanges serve to limit the inward movement of these elastic band actuated trapezoidal face panel pairs, thus preserving the integrity of the structure and minimizing misalignment.

An embodiment of the invention using no internal guide flanges is illustrated in FIG. 6. In this blank 64 embodiment each trapezoidal face panel is provided with an integral lateral extension illustrated by the long slim triangles 28A and 38A shown in FIG. 6 forming the slight lateral extensions of the trapezoidal face panels 28 and 38 respectively. The base of triangles 28A and 38A is formed by a short lateral extension of the normal fold line between face panel 28 and tab 48 in FIG. 6, where this extension is identified as 28B. A similar extension 38B of the counterclockwise end of the longer parallel edge of trapezoidal face panel 38 and corresponding extensions of the long parallel edges of panels 23–27 and 33–37 all identified by the reference numerals 23B–27B and 33B–37B in FIG. 6 comprise the features of the blank of FIG. 6 producing the desired guiding stabilizing operation of the assembled structure.

Figure 6B:
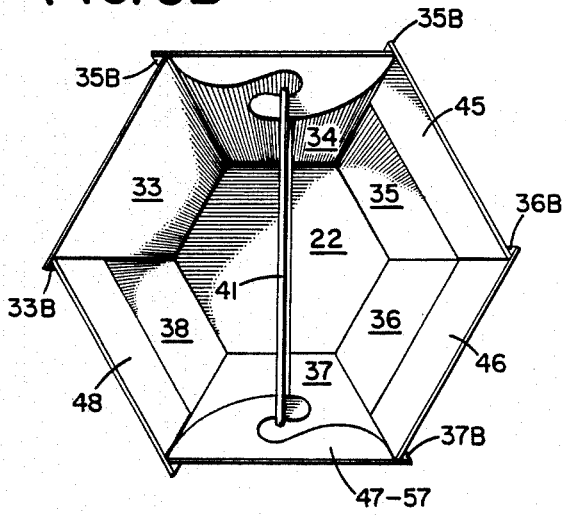

As shown in the central portion of the blank 64 of FIG. 6, the counterclockwise extension 23B formed on face panel 23 of the upper portion of the blank extends in the opposite direction from the extension 33B formed at the counterclockwise end of the same fold line on contiguous face panel 33. In a corresponding manner, the extensions for each trapezoidal face panel protrude in the direction opposite to the extensions for its mating trapezoidal face panel. In the self-erected condition of the same structure illustrated in FIG. 6B, the cross-sectional plan view taken across the equatorial plane shows the lower portion of the blank of FIG. 6 assembled and self-erected with elastic band 41 drawing flanges 44–45 toward flanges 47–57 actuating the mating pairs of trapezoidal face panels 24–34 and 27–37 toward each other. As shown in FIG. 6B, glue tab 48 is bonded to the inner face of face panel 38 and the same is true of glue tabs 45 and 46 respectively bonded to the inner faces of trapezoidal face panels 35 and 36. The conjoined trapezoidal face panels 23 and 33 have a common fold line 31 along their longer parallel edges with no glue tab. Accordingly, there are no interior guide flanges required in the embodiment of FIGS. 6, 6A, and 6B. Instead, the lateral extensions 23B–28B and 33B–38B all tend to limit the inward movement of the mating pairs of trapezoidal face panels. Thus, as flange 44–45 is drawn by band 41 toward flange 47–57, the lateral extensions 34B and 37B are brought into juxtaposition with the mating edges of the adjoining trapezoidal face panel 33 and 36 respectively, thereby limiting the inward movement of the actuated pairs of trapezoidal face panels. Inward movement of the other pairs of face panels is similarly limited by extensions 33B, 35B, 36B and 38B. In the same manner, the corresponding extensions 23B through 28B formed on the upper half of the structure extend in the opposite direction because the folding over of the upper half of blank 64 about fold line 31 shown in FIG. 6 inverts the left-hand half of the blank 21–28 and brings it into juxtaposition over the right-hand half of the blank 22–33–38. This causes all of the extensions 23B–28B to protrude from the opposite ends of the common equatorial fold lines corresponding to the mating long parallel edges of the six pairs of trapezoidal face panels. Accordingly the counterclockwise-extending projections 33B–38B performing the function of guide flanges directly beneath the equatorial plane shown in FIG. 6B are supplemented by the oppositely extending projections 23B–28B directly above the equatorial plane, not shown in FIG. 6B.

While this embodiment of the invention possesses the inherent stability and resistance to deformation of the other embodiments, the slight intentional misalignment of the equatorial corners of the structure are perceptible on close examination, and for this reason users may prefer the other embodiments of the invention incorporating internal guide flanges which are completely hidden by the mating trapezoidal face panels, with substantially exactly corresponding long parallel edges along the equatorial plane.

Figure 7B:
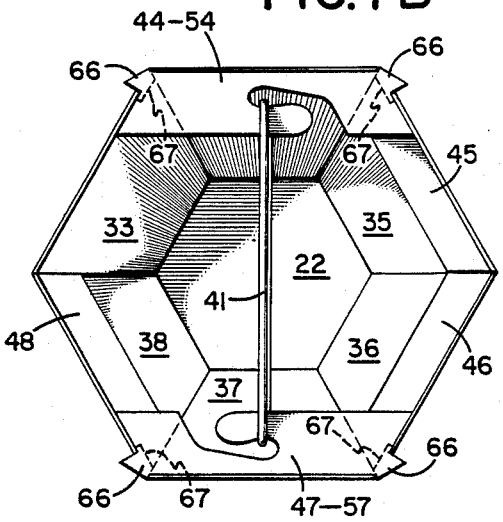

A different form of corner-locking construction providing a modified version of the guide flanges of the present invention is illustrated in the blank of FIG. 7, together with FIGS. 7A and 7B respectively showing the assembled and flattened condition of this structure, and the resiliently self-erected condition of the same structure. In these FIG.S, the lateral edges of the glue tabs protruding from trapezoidal face panels 24, 34, 27 and 37 are all formed with tab extensions 66 protruding laterally beyond the preferred 120-degree included angle lateral edge of the glue tab. Tabs 66 are all aligned to interfit within mating slots 67 forming short proximal cutaway portions of the adjoining fold line between the two adjacent trapezoidal face panels on the equatorial plane of the structure. Thus, as shown in FIGS. 7 and 7B, tabs 66 extending laterally beyond the normal lateral edge of the actuated glue tab flange 44–54 extend outward on the equatorial plane slightly beyond the normal periphery of the structure, protruding through slots 67 formed in the adjacent panels 33 and 35 and thereby limiting the elastic self-erection of the structure, impelled by an elastic band 41, through the abutting engagement of tab 66 with the base of slot 67 on each side of actuated guide flange 44–54, while at the same time bringing the normal lateral edge of the guide flange into abutting engagement inside the equatorial fold line joining trapezoidal face panel 33 to its mating face panel 23 in the upper portion of the structure, and also abutting the inside of the equatorial fold line joining trapezoidal face panel 35 with its mating trapezoidal face panel 25 by way of the glue tab 45 extending from panel 25 into adhesive engagement with the interior face of face panel 35. In the same fashion, as shown in the lower portion of FIG. 7B, corresponding tabs 66 interfit in a locking fashion with slots 67 formed in the pairs of trapezoidal face panels adjacent to face panels 27 and 37 from with the actuated guide flanges 47–57 protrude inward.

Thus, the inward movement of the actuated guide flanges 44–54 and 47–57 is restricted by the engagement of tabs 66 with slots 67, while the corresponding inward movement of the adjoining pairs of trapezoidal face panels is similarly limited by the abutting engagement of the lateral edges of these two pairs of actuated internal guide flanges with the interior equatorial fold lines of the adjacent pairs of trapezoidal face panlls, thus rigidly stabilizing the structure and resisting its misalignment and deformation when the elastically self-erected condition shown in FIG. 7B is achieved.

FIGS. 8 and 9 show two additional variations on the previous embodiments of the present invention. The embodiment of FIG. 8 may be considered a variation of the structure shown in FIG. 6, where lateral tab extensions on one end of the long parallel edge of each trapezoidal face panel are employed to protrude beyond the normal outer corners of the equatorial plane of the structure to block its self-erection in the desired erected position. In the blank of FIG. 8, similar lateral extensions are formed at both ends of the long parallel edge of two mating pairs of trapezoidal face panels, these being the face panels which carry the self-actuated glue tabs forming internal guide flanges and providing the self-erecting actuation of the structure.

Figure 8B:
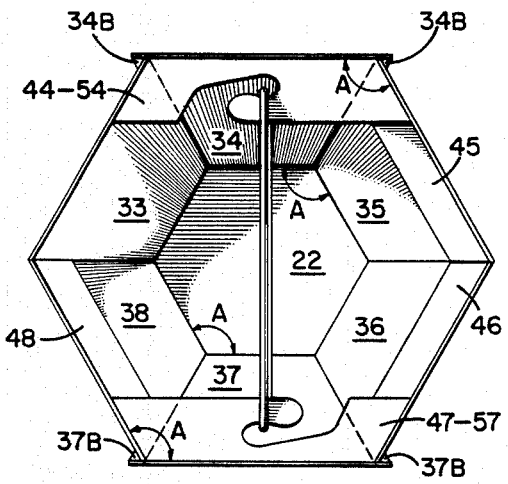

In the device shown in FIGS. 6, 6A and 6B, it will be noted that each of the six corners in the equatorial plane are protected by oppositely extending tab extensions in the upper and lower portions of the structure. In the device of FIG. 8, however, only four of the six corners are protected with the tab extensions 24B and 27B protruding laterally in both directions on the two actuated pairs of trapezoidal face panels which are thus drawn up by elastic band 41 into abutting engagement with the diverging edges of the adjacent pairs of trapezoidal face panels, at the same time the lateral edges of the glue tabs 44–54 and 47–57 themselves are formed as illustrated in FIGS. 2, 5 and 7, for example, with the preferred included angle A between their lateral edges and their base fold line corresponding substantially identically to the included angles A of the polygons forming the top and bottom face panels 21 and 22, and measuring 120 degrees in the illustrated embodiments of the invention. The lateral end edges of tabs 44–54 thus serve as internal guide flanges limiting the inward movement of the adjacent pairs of trapezoidal face panels 25–35 and 23–33. In the same manner, the lateral end edges of glue tabs 47–57 form internal guide flanges limiting the inward movement of the adjacent pairs of trapezoidal face panel 26–36 and 28–38, all as illustrated in FIG. 8B.

The embodiment illustrated in FIG. 9 will be observed to be very similar to that shown in FIG. 4 with the exception that panel 59 in FIG. 4 has now been replaced by a separate hexagonal panel 59A dimensioned to occupy the entire equatorial plane of the erected structure and being bounded by six sides of a hexagon, each corresponding in length to the length of the long parallel edge of each trapezoidal face panel. Separate guide flange panel 59A is preferably severed from the same sheet material from which blank 68 of FIG. 9 is severed, and in all other respects it will be observed that the two-part blank 68 of FIG. 9, corresponds to the one-part blank 60 of FIG. 4. When the blank of FIG. 9 is assembled, the folding and gluing of the various glue tabs is substantially identical to the procedure for assembling the blank of FIG. 4, but the hexagonal guide flange panel 59A must be positioned between the two halves of blank 68 of FIG. 9 before this gluing procedure is performed. In addition, the guide flange panel 59A must be maneuvered to assure that it is not trapped between any two mating adhesively bonded surfaces during the gluing operation. Guide flange panel 59A shown in FIG. 9A is free to move within the flattened assembled structure of blank 68. Upon self-erection by elastic band 41, the rising motion separating panels 21 and 22 and tending to draw in the peripheral edges of the six pairs of trapezoidal face panels automatically maneuvers guide flange panel 59A into its desired position totally filling the equatorial plane of the structure and serving the exact function of all the internal guide flanges, by assuring the adjoining alignment of each adjacent pair of diverging face panel edges as they move together during the self-erecting actuation of the structure.

Another embodiment of the present invention is illustrated in FIG. 10 where the two separate portions of the blank 69 corresponding to the blanks of the previous embodiments are separately severed from their sheet material. The glue tab foldably joined to the edge of trapezoidal face panel 23 in the upper portion of blank 69 is greatly enlarged, by comparison with the glue tabs of all of the previous embodiments, and formed to span the entire equatorial width of the erected polygonal structure, comprising a generally rectangular pull tab 71. This pull tab 71 is provided with lateral edges adjacent to its fold line joining it to panel 23 and forming therewith the same angle A previously defined as matching the included apex angles of polygonal top face panel 21, as shown at the left side of FIG. 10. These lateral side edges 72 blend into an elongated span edge 73 extending part way along each side of panel 71, with an elastic band notch 74 being formed in the side edge 73 close to its junction with the diverging lateral side edges 72 and near the fold line with face panel 23. The distal end of pull tab panel 71 remote from face panel 23 has a reduced width "W" formed by cutaway corners 76, between which the width "W" of panel 71 is selected not to exceed the length of the long parallel edge of trapezoidal face panel 26, opposite panel 23 to which the pull tab panel 71 is foldably joined.

The opposite or lower half of blank 69 of FIG. 10 is formed with a similar pull tab panel 77, foldably joined to trapezoidal face panel 36 along its long parallel edge and otherwise panel 77 has the same features as panel 71: notches 74, cutaway corners 76 and width "W" across its distal end.

Figure 10B:
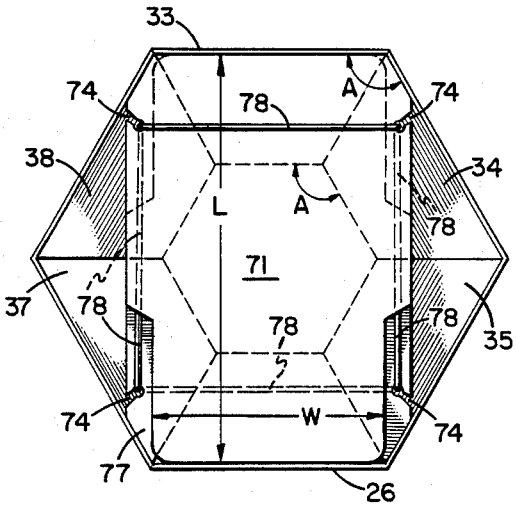

The length "L" of pull tab panels 71 and 77 is selected to match the minimum dimension across the equatorial plane of the structure of FIG. 10, 10A and 10B, as indicated in the cross-sectional top plan view of FIG. 10B taken along the equatorial plane. In this embodiment of the invention, the elastic band 78 has one end spanning the width of pull tab panel 77 between its notches 74 with its opposite end being drawn lengthwise past the distal end of panel 77 to span the opposite pull tab panel 71 between its notches 74, as shown in FIGS. 10A and 10B. In this Figure, the width "W" of the distal ends of each of the panels 71 and 77 is equal to or less than the overall length of the long parallel edge of the adjoining trapezoidal face panel 26 or 33, as indicated in FIGS. 10A and 10B. Flattening and collapse of the structure assembled from the blank of FIG. 10 draws the overlapping, sliding pull tab panels 71 and 77 apart, stretching band 78. The self-erecting actuation caused by the contraction of elastic band 78 draws the notches 74 of the respective overlapping pull tab panels 71 and 77 closer together, causing these panels to slide past each other until their opposite distal ends come into abutting engagement with the pair of trapezoidal face panels opposite their respective fold lines in the position shown in FIG. 10B, corresponding to the erected pop-up configuration of the structure.

Thus, in each of the various embodiments of the invention, the guide flanges bearing against the interior equatorial fold lines of adjacent pairs of trapezoidal face panels, or guide flanges cooperating in similar ways with these adjacent pairs of trapezoidal face panels serve to restrict and limit the relative radial movement of each adjacent pair of trapezoidal face panels forming the pop-up structures of this invention. By this means, these adjacent pairs of face panels are prevented from serious misalignment and the structural integrity of the resulting pop-up polygonal structure is assured, enhancing the attractive appearance and the prolonged useful life of these pop-up structures.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope if the invention which, as a matter of language, might be said to fall therebetween.

What is claimed is:

1. A collapsible, flattenable pop-up structure formed of stiff foldable sheet material, having a collapsed mode in which it is flattened into a thin substantially co-planar structure for storage, and self-erectable into an erect mode configuration resembling a polygonal solid with pairs of upper and lower trapezoidal face panels, having short parallel edges foldably joined to the sides of similar polygonal top and bottom face panels, and extending therefrom diagonally outward to meet in an equatorial plane with their longer parallel edges foldably joined together to define an equatorial plane polygon similar to but larger than the top and bottom polygonal face panels, characterized by notched actuating flanges formed by glue tabls foldably joined to the long parallel edges of two opposed mating pairs of upper and lower trapezoidal face panels and having notch hook means formed therein presented protruding inward facing each other on opposed sides of the equatorial plane inside the flattenable pop-up structure.

elastic band means connecting the opposed notch hook means resiliently urging the opposed actuating flanges toward each other, and guide flange means positioned at the apices of the equatorial plane polygon to guide the foldably joined longer parallel sides of at least two adjacent pairs of upper and lower trapezoidal face panels into sliding apex juxtaposition with each other while blocking their respective inward movement past each other beyond the aligned apex juxtaposition of said erect configuration, while providing free sliding disengagement for flattening collapse of the structure, whereby the self-erecting force supplied by the stretched elastic band means is counteracted by the guide flange means when the two adjacent pairs of trapezoidal face panels arrive at juxtaposition at an apex of the equatorial plane polygon in the erect configuration of the structure, and flattening forces applied to move the two similar top and bottom face panels toward each other disengage the guide flange means while stretching the elastic band means, causing the structure to move from its erect mode eonfiguration to its collapsed mode.

2. The flattenable pop-up structure defined in claim 1 wherein the similar top and bottom face panels are polygons having a plurality of included apex angles between adjacent sides at their apices, and wherein at least two pairs of said guide flange means are formed from said actuating flanges and provided with diverging lateral end edges, each end edge at one first end of a diverging side of a trapezoidal face panel forming with the adjoining long parallel edge of said face panel an included angle substantially equal to the apex angle of the top or bottom polygonal face panel at the opposite second end of said diverging side of the trapezoidal face panel.

3. The flattenable pop-up structure defined in claim 1 wherein the similar top and bottom face panels are regular polygons having equal angles A included between adjacent sides at each apex, and wherein at least two pairs of said guide flange means are formed from said notched actuating flanges and provided with diverging lateral end edges, forming with each of the long parallel edges of the trapezoidal face panels to which they are foldably joined, included angles substantially equal to the same angle A.

4. The flattenable pop-up structure defined in claim 3, wherein said top and bottom face panels and said equatorial plane polygon are all regular hexagons, and where the angle A is substantially equal to 120 degrees.

5. The flattenable pop-up structure defined in claim 2 wherein all of said pairs of said upper and lower trapezoidal face panels are provided with equatorial guide flanges extending into the interior of said structure from their foldably joined long parallel edges and having divergnng lateral end edges extending behind the equatorial foldable junction of an adjacent pair of trapezoidal face panels, limiting the relative inward flexing movement of said adjacent pair of face panels.

6. The flattenable pop-up structure defined in claim 1 wherein the guide flange means are formed in an equatorial panel extending across the equatorial plane of said structure in its erect configuration from the foldably joined long parallel edges of a first pair of trapezoidal face panels to the foldably joined long parallel edges of a second opposite pair of trapezoidal face panels.

7. The flattenable pop-up structure defined in claim 6 wherein said equatorial panel is formed as a polygon occupying substantially the entire interior portion of the equatorial plane of said structure coinciding with said equatorial plane polygon.

8. The flattenable pop-up structure defined in claim 7 wherein said equatorial panel polygon is foldably joined to the long parallel edge of one of said trapezoidal face panels.

9. The flattenable pop-up structure defined in claim 6 wherein the equatorial panel is formed in two slidable overlapping segments resiliently urged into overlapping superposition by said elastic band means.

10. The flattenable pop-up structure defined in claim 1 wherein the guide flange means comprise lateral extensions of the foldably joined long parallel sides of at least two opposed pairs of upper and lower trapezoidal face panels produced by lateral prolongation of one diverging edge of one said trapezoidal face panel.

11. The flattenabl pop-up structures defined in claim 10 wherein the lateral prolongations of both foldably joined trapezoidal face panels extend in the same direction.

12. The flattenable pop-up structures defined in claim 10 wherein the lateral prolongations of the panels forming each foldably joined pair of trapezoidal face panels extend in opposite directions.

13. The flattenable pop-up structures defined in claim 10 wherein two opposed pairs of foldably joined trapezoidal face panels are provided with lateral prolongations of both their diverging sides extending in outward lateral directions.

14. The flattenable pop-up structures defined in claim 1 wherein said guide means are formed as laterally protruding tab extensions formed on the lateral edges of said actuating flanges, and wherein the pairs of said foldably joined trapezoidal face panels adjacent to the face panels supporting the actuating guide flanges are provided with cut-out notches shortening the lateral ends of their foldable equatorial junction lines dimensioned to receive and embrace said protruding tab extensions.

15. The flattenable pop-up structure defined in claim 3 wherein the angles A defining the lateral end edges of said guide flanges are selected from the following values corresponding to the number of equal sides incorporated in the regular polygonal top and bottom panels employed in the structure:

| Regular Polygon | No. of Sides | Angle A |
|---|---|---|
| Equilateral Triangle | 3 | 60 degrees |
| Square | 4 | 90 degrees |
| Pentagon | 5 | 108 degrees |
| Hexagon | 6 | 120 degrees |
| Heptagon | 7 | 128.6 degrees |
| Octagon | 8 | 135 degrees. |

* * * * *